US008293956B2

(12) United States Patent
Felix-Moore et al.

(10) Patent No.: US 8,293,956 B2
(45) Date of Patent: Oct. 23, 2012

(54) GASOLINE COMPOSITIONS

(75) Inventors: Allison Felix-Moore, Chester (GB); Richard John Price, Chester (GB); Susan Jane Smith, Chester (GB)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 12/862,533

(22) Filed: Aug. 24, 2010

(65) Prior Publication Data

US 2012/0053376 A1 Mar. 1, 2012

(51) Int. Cl.
*C10L 1/06* (2006.01)
*C10L 1/16* (2006.01)

(52) U.S. Cl. ..... 585/14; 208/16; 208/17; 44/300

(58) Field of Classification Search ..... 585/14; 208/16, 17; 44/300
See application file for complete search history.

(56) References Cited

U.S. PATENT DOCUMENTS

| | | | | |
|---|---|---|---|---|
| 1,405,809 | A | 2/1922 | Whitaker | |
| 4,036,604 | A * | 7/1977 | Simon | 44/438 |
| 4,098,585 | A | 7/1978 | Vartanian et al. | 44/63 |
| 4,131,434 | A | 12/1978 | Gonzalez | 44/62 |
| 4,818,250 | A * | 4/1989 | Whitworth | 44/430 |
| 5,186,722 | A * | 2/1993 | Cantrell et al. | 44/605 |
| 5,501,713 | A * | 3/1996 | Wilkins, Jr. | 44/307 |
| 5,575,822 | A * | 11/1996 | Wilkins, Jr. | 44/307 |
| 5,607,486 | A * | 3/1997 | Wilkins, Jr. | 44/307 |
| 5,855,629 | A | 1/1999 | Grundy et al. | 44/400 |
| 5,935,276 | A * | 8/1999 | DeRosa et al. | 44/337 |
| RE37,629 | E * | 4/2002 | Wilkins, Jr. | 44/307 |
| 7,828,862 | B2 * | 11/2010 | Leung | 44/439 |

FOREIGN PATENT DOCUMENTS

| | | |
|---|---|---|
| GB | 682869 | 9/1949 |

* cited by examiner

*Primary Examiner* — Ellen McAvoy

(57) ABSTRACT

A gasoline composition is provided containing:
(a) a gasoline base fuel; and
(b) a terpene composition in an amount in the range of from 0.1 to 40% vol. based on total gasoline composition, said terpene composition comprising at least 60% wt. pinenes and having an acidity of at most 0.05 mgKOH/g.

22 Claims, No Drawings

GASOLINE COMPOSITIONS

FIELD OF THE INVENTION

The present invention provides a gasoline composition comprising terpenes.

BACKGROUND OF THE INVENTION

Terpenes are a naturally occurring class of hydrocarbons that are derived biosynthetically from isoprene ($C_5H_8$) units. Mono-terpenes consist of two isoprene units and have a molecular formula of $C_{10}H_{16}$. Mono-terpenes are non-oxygen containing bio-derived hydrocarbons that have appropriate volatility for consideration for use in gasoline.

Pinenes are bicyclic mono-terpenes, consisting of two isoprene units and have a molecular formula of $C_{10}H_{16}$. Turpentine is a mixture of various terpenes, including pinene, and is primarily derived from living trees (as gum turpentine) or as a by-product of the wood and paper pulp industry (as crude sulphate turpentine or CST).

The use of terpenes, and in particular pinenes, in fuel compositions is known for example, U.S. Pat. No. 1,405,809 discloses liquid fuel compositions which contain a terpene; in particular disclosing pine oil as a source of pinene.

U.S. Pat. No. 4,131,434 discloses in Table C an example of an additive formulation for a gasoline composition which contains a number of components, one of which is a terpene component. The additive formulation is tested in gasoline formulations for a range of properties, of which copper corrosion is one. No significant effect on copper corrosion is noted. The concentration of terpene component, specified as bicyclic compounds $C_{10}H_{16}$ pinene, in each gasoline composition tested is 0.018% vol.

It has been observed that the use of terpenes, in particular the use of terpene compositions comprising pinene in sufficient amounts, in gasoline compositions can give rise to various problems which it would be desirable to overcome.

In particular, it has been observed that the use of terpene compositions comprising pinene in a gasoline composition can cause an unacceptably high level of metal pick-up, i.e. the tendency to pick up metals (or leach metals) during transportation and storage in the supply and distribution system and also in vehicles fueled with the fuel. This unacceptably high level of metal pick-up may potentially lead to problems in the engine and the supply chain, for example the leached metals may lead to problems in terms of fouling of certain components.

Furthermore, steel corrosion caused by gasoline in engines and during the transportation of gasoline is undesirable and may also lead to problems in engines and the supply chain.

SUMMARY OF THE INVENTION

The present invention provides a gasoline composition comprising:

(a) a gasoline base fuel; and (b) a terpene composition in an amount in the range of from 0.1 to 40% vol. based on total gasoline composition, said terpene composition comprising at least 60% wt. pinenes and having an acidity of at most 0.05 mgKOH/g.

The present invention further provides a process for preparing a gasoline composition, comprising admixing with a gasoline base fuel, a terpene composition in an amount in the range of from 0.1 to 40% vol. based on total gasoline composition, said terpene composition comprising at least 60% wt. pinenes and having an acidity of at most 0.05 mgKOH/g.

The present invention further provides the use of a terpene composition, said terpene composition comprising at least 60% wt. pinenes and having an acidity of at most 0.05 mgKOH/g, as a corrosion inhibitor in a gasoline composition, in an amount in the range of from 0.1 to 40% vol. based on total gasoline composition.

The present invention yet further provides a method for reducing the metal pick-up propensity of terpene containing gasoline composition, said method comprising using a terpene composition which comprises at least 60% wt. pinenes and has an acidity of at most 0.05 mgKOH/g as the terpene component of the gasoline composition, in an amount in the range of from 0.1 to 40% vol. based on total gasoline composition.

The present invention provides a gasoline composition containing a terpene composition which comprises pinene, wherein said gasoline composition exhibits improved performance in at least one of the parameters which have the above identified problems.

DETAILED DESCRIPTION OF THE INVENTION

The gasoline composition of the present invention comprises a gasoline base fuel and a terpene composition in an amount in the range of from 0.1 to 40% vol. based on total gasoline composition, wherein said terpene composition comprises at least 60% wt. pinenes and has an acidity of at most 0.05 mgKOH/g.

The gasoline base fuel (also referred to as base gasoline) may be any gasoline suitable for use in an internal combustion engine of the spark-ignition (petrol) type known in the art.

Gasolines typically comprise mixtures of hydrocarbons boiling in the range from 25 to 230° C. (EN-ISO 3405), the optimal ranges and distillation curves typically varying according to climate and season of the year. The hydrocarbons in a gasoline may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline are not critical.

Conveniently, the research octane number (RON) of the gasoline may be at least 80, for instance in the range of from 80 to 110, preferably the RON of the gasoline will be at least 90, for instance in the range of from 90 to 110, more preferably the RON of the gasoline will be at least 91, for instance in the range of from 91 to 105, even more preferably the RON of the gasoline will be at least 92, for instance in the range of from 92 to 103, even more preferably the RON of the gasoline will be at least 93, for instance in the range of from 93 to 102, and most preferably the RON of the gasoline will be at least 94, for instance in the range of from 94 to 100 (EN 25164); the motor octane number (MON) of the gasoline may conveniently be at least 70, for instance in the range of from 70 to 110, preferably the MON of the gasoline will be at least 75, for instance in the range of from 75 to 105, more preferably the MON of the gasoline will be at least 80, for instance in the range of from 80 to 100, most preferably the MON of the gasoline will be at least 82, for instance in the range of from 82 to 95 (EN 25163).

Typically, gasolines comprise components selected from one or more of the following groups; saturated hydrocarbons, olefinic hydrocarbons, aromatic hydrocarbons, and oxygenated hydrocarbons. Conveniently, the gasoline may comprise a mixture of saturated hydrocarbons, olefinic hydrocarbons, aromatic hydrocarbons, and, optionally, oxygenated hydrocarbons.

Typically, the olefinic hydrocarbon content of the gasoline is in the range of from 0 to 40 percent by volume based on the gasoline (ASTM D1319); preferably, the olefinic hydrocarbon content of the gasoline is in the range of from 0 to 30 percent by volume based on the gasoline, more preferably, the olefinic hydrocarbon content of the gasoline is in the range of from 0 to 20 percent by volume based on the gasoline.

Typically, the aromatic hydrocarbon content of the gasoline is in the range of from 0 to 70 percent by volume based on the gasoline (ASTM D1319), for instance the aromatic hydrocarbon content of the gasoline is in the range of from 10 to 60 percent by volume based on the gasoline; preferably, the aromatic hydrocarbon content of the gasoline is in the range of from 0 to 50 percent by volume based on the gasoline, for instance the aromatic hydrocarbon content of the gasoline is in the range of from 10 to 50 percent by volume based on the gasoline.

The benzene content of the gasoline is at most 10 percent by volume, more preferably at most 5 percent by volume, especially at most 1 percent by volume based on the gasoline.

The gasoline preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline also preferably has a low total lead content, such as at most 0.005 g/l, most preferably being lead free—having no lead compounds added thereto (i.e. unleaded).

When the gasoline comprises oxygenated hydrocarbons, at least a portion of non-oxygenated hydrocarbons will be substituted for oxygenated hydrocarbons. The oxygen content of the gasoline may be up to 35 percent by weight (EN 1601) (e.g. ethanol per se) based on the gasoline. For example, the oxygen content of the gasoline may be up to 25 percent by weight, preferably up to 10 percent by weight. Conveniently, the oxygenate concentration will have a minimum concentration selected from any one of 0, 0.2, 0.4, 0.6, 0.8, 1.0, and 1.2 percent by weight, and a maximum concentration selected from any one of 5, 4.5, 4.0, 3.5, 3.0, and 2.7 percent by weight.

Examples of oxygenated hydrocarbons that may be incorporated into the gasoline include alcohols, ethers, esters, ketones, aldehydes, carboxylic acids and their derivatives, and oxygen containing heterocyclic compounds. Preferably, the oxygenated hydrocarbons that may be incorporated into the gasoline are selected from alcohols (such as methanol, ethanol, propanol, iso-propanol, butanol, tert-butanol and iso-butanol), ethers (preferably ethers containing 5 or more carbon atoms per molecule, e.g., methyl tert-butyl ether) and esters (preferably esters containing 5 or more carbon atoms per molecule); a particularly preferred oxygenated hydrocarbon is ethanol.

When oxygenated hydrocarbons are present in the gasoline, the amount of oxygenated hydrocarbons in the gasoline may vary over a wide range. For example, gasolines comprising a major proportion of oxygenated hydrocarbons are currently commercially available in countries such as Brazil and U.S.A, e.g. ethanol per se and E85, as well as gasolines comprising a minor proportion of oxygenated hydrocarbons, e.g. E10 and E5. Therefore, the gasoline may contain up to 100 percent by volume oxygenated hydrocarbons. Preferably, the amount of oxygenated hydrocarbons present in the gasoline is selected from one of the following amounts: up to 85 percent by volume; up to 65 percent by volume; up to 30 percent by volume; up to 20 percent by volume; up to 15 percent by volume; and, up to 10 percent by volume, depending upon the desired final formulation of the gasoline. Conveniently, the gasoline may contain at least 0.5, 1.0 or 2.0 percent by volume oxygenated hydrocarbons.

Examples of suitable gasolines include gasolines which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Whilst not critical to the present invention, the base gasoline or the gasoline composition of the present invention may conveniently additionally include one or more fuel additive. The concentration and nature of the fuel additive(s) that may be included in the base gasoline or the gasoline composition of the present invention is not critical. Non-limiting examples of suitable types of fuel additives that can be included in the base gasoline or the gasoline composition of the present invention include anti-oxidants, corrosion inhibitors, detergents, dehazers, antiknock additives, metal deactivators, valve-seat recession protectant compounds, dyes, friction modifiers, carrier fluids, diluents and markers. Examples of suitable such additives are described generally in U.S. Pat. No. 5,855,629.

Conveniently, the fuel additives can be blended with one or more diluents or carrier fluids, to form an additive concentrate, the additive concentrate can then be admixed with the base gasoline or the gasoline composition of the present invention.

The (active matter) concentration of any additives present in the base gasoline or the gasoline composition of the present invention is preferably up to 1 percent by weight, more preferably in the range from 5 to 1000 ppmw, advantageously in the range of from 75 to 300 ppmw, such as from 95 to 150 ppmw.

The terpene compositions used in the gasoline compositions of the present invention are terpene compositions which comprise pinene(s). The amount of pinene(s) in the terpene compositions used in the gasoline compositions of the present invention is at least 60% wt., preferably at least 70% wt., more preferably at least 75% wt, even more preferably at least 80% wt. Conveniently, the amount of pinene(s) in the terpene compositions used in the gasoline compositions of the present invention may be at least 85% wt., more conveniently at least 90% wt.

In one embodiment of the present invention, the terpene composition used in the gasoline compositions of the present invention comprises at least 60% wt. alpha-pinene, preferably at least 70% wt. alpha-pinene, more preferably at least 75% wt, more preferably at least 80% wt. Conveniently, the amount of alpha-pinenes in the terpene compositions used in the gasoline compositions of the present invention may be at least 85% wt., more conveniently at least 90% wt.

Typically, the terpene composition used in the gasoline compositions of the present invention comprises at least 3% wt. beta-pinene, more typically at least 4% wt. beta-pinene or even 5% wt. beta-pinene.

In one embodiment of the present invention, the terpene composition used in the gasoline compositions of the present invention may additionally comprise at least 0.5% wt. limonene, more typically at least 1% wt. limonene.

In another embodiment of the present invention, the terpene composition used in the gasoline compositions of the present invention may additionally comprise at least 0.5% wt. 3-carene, more typically at least 1% wt. 3-carene.

By the term "metal pick-up" it is meant the tendency for the fuel to pick up, or leach, metals during transportation and storage in the supply and distribution system, and also in the fuel system of the engine which it is fuelling.

High levels of metal pick-up are undesirable in gasoline compositions as it is believed that certain metals, such as copper, iron and zinc, may contribute to certain types of engine fouling, such as injector nozzle fouling, and certain metals, such as lead, may lead to the emission of harmful substances from the engine.

It has been noted that when terpene compositions are blended with gasoline, the metal pick-up propensity of the gasoline composition may significantly increase. It has been found that by reducing the acidity of the terpene composition used in a gasoline composition, the propensity of gasoline compositions containing the terpene composition to pick-up certain metals may be reduced.

Therefore, the acidity of the terpene composition used in the gasoline composition of the present invention, as measured in accordance with ASTM D1613-2, is at most 0.05 mgKOH/g, preferably at most 0.025 mgKOH/g. More preferably, the acidity of the terpene composition used in the gasoline composition of the present invention is at most 0.02 mgKOH/g, even more preferably at most 0.015 mgKOH/g, and most preferably at most 0.01 mgKOH/g.

The acidity of the terpene composition can be reduced by any method known in the art, for example by passing the terpene composition over an absorbent such as alumina.

Therefore, the present invention also provides a method for reducing the metal pick-up propensity of a terpene-containing gasoline composition, said method comprising using a terpene composition which comprises at least 60% wt. pinenes and has an acidity of at most 0.05 mgKOH/g as the terpene component of the gasoline composition in an amount in the range of from 0.1 to 40% vol. based on total gasoline composition.

By the term "reducing the metal pick-up propensity of a terpene-containing gasoline composition", it is meant that the propensity of the terpene-containing gasoline composition to pick-up at least one metal is reduced.

It has also been observed that when a terpene composition as described above is used, the propensity of the base gasoline to cause corrosion of steel can be reduced.

Therefore, the present invention also provides the use of a terpene composition comprising at least 60% wt. pinenes and having an acidity of at most 0.05 mgKOH/g, as a corrosion inhibitor in a gasoline composition, when present in an amount in the range of from 0.1 to 40% vol. based on total gasoline composition.

Advantageously, the terpene composition may be conveniently derived from a renewable biological source. Therefore, the gasoline compositions of the present invention may conveniently have an increased bio-fuel content.

The terpene composition is present in a concentration of at most 40% vol., based on the total volume of the gasoline composition. The terpene composition admixed with the gasoline base fuel in the present invention is present in various concentration ranges having a lower limit of from 0.1% vol., preferably from 0.5% vol., more preferably from 1% vol., and conveniently from 2% vol., and an upper limit of at most 40% vol., preferably 35% vol., more preferably 30% vol., even more preferably 25% vol., and conveniently 20% vol., based on the total volume of the gasoline composition (e.g. 0.1-40% vol., 0.1-35% vol., 0.1-30% vol., 0.1-25% vol., 0.1-20% vol., 0.5-40% vol., 0.5-35% vol., 0.5-30% vol., 0.5-25% vol., 0.5-20% vol., 1-40% vol., 1-35% vol., 1-30% vol., 1-25% vol., 1-20% vol., 2-40% vol., 2-35% vol., 2-30% vol., 2-25% vol. and 2-20% vol.).

The terpene composition suitably is present in an amount in the range of from 2 to 10% vol., most suitably 3 to 6% vol., in the final gasoline composition.

The terpene composition very suitably is present in an amount that provides in the range of from 1 to 10% vol., preferably from 3 to 6% vol., and especially from 4 to 5% vol., of pinene, and especially of α-pinene, in the final gasoline composition.

The present invention further provides a process of preparing a gasoline composition, comprising admixing with a gasoline base fuel as described above, a terpene composition as described above. The amount of the terpene composition admixed with the gasoline base fuel in the process of preparing a gasoline composition of the present invention is in accordance with the amounts described above.

The present invention further provides a method of operating a spark-ignition internal combustion engine, which method involves introducing into a combustion chamber of the engine a gasoline composition according to the present invention.

The present invention will be further understood from the following non-limiting examples, which illustrate the effects of terpene compositions on the metal pick-up propensity of gasoline compositions and on the propensity of gasoline compositions to cause corrosion of steel.

EXAMPLES

Example 1

Reduction of Acidity of a Pinene Composition

A sample of gum turpentine having the composition described in Table 1 below was passed through a bed of alumina.

TABLE 1

Properties of the gum turpentine sample.

| Main mono-terpenes | α-pinene (78% wt), 9% wt beta-pinene, 3% wt limonene |
|---|---|
| Sulphur (ASTM D2622) | <5 ppm |
| Density at 15° C. (IP 365) | 0.8637 kg/L |
| Acidity (ASTM D1613-2) | 0.19 mg KOH/g |

The treated sample of gum turpentine was analysed and shown to have an acidity of less than 0.01 mgKOH/g.

Examples 2-22 and Comparative Examples A-U

In the following examples, gasoline compositions containing 5% v/v of a pinene composition were used. The details of the five different pinene compositions (P1-P5) used to prepare the gasoline compositions used in the following examples are provided in Table 2 below. Pinene compositions P1 to P4 are gum turpentine samples and pinene composition P5 is a crude sulphate turpentine sample.

Three different base gasolines were used to prepare the gasoline compositions used in the following examples. Base gasolines "Base 1" and "Base 2" were non-ethanol containing gasoline compositions. Base gasoline "E10" was an E10 base gasoline (gasoline containing 10% v/v ethanol) based on base gasoline "Base 1".

The details of base gasoline compositions "Base 1" and "Base 2" are provided in Table 3 below.

TABLE 2

Properties of pinene composition

| Property | Method | P1 | P2 | P3 | P4 | P5 |
|---|---|---|---|---|---|---|
| Alpha-pinene content (% wt.) | N/A | 95% | 95% | 95% | 90% | 95% |
| Appearance | ASTM D4176 | Clear & Bright | Clear & Bright | Clear & Bright | Clear & Bright | Clear & Bright |
| Colour | ASTM D1500 | <0.5 Water White | <0.5 Water White | <0.5 Water White | <0.5 Water White | Water White |
| Density (15° C.) (kg/m$^3$) | IP365 | 862.6 | 862.7 | 862.8 | 863.5 | 862.8 |
| Water (% m/m) | ASTM D1364 | 0.01 | <0.01 | 0.01 | 0.01 | <0.01 |
| Sulphur (mg/kg) | ASTM D2622 | <5 | <5 | <5 | <5 | |
| Peroxides (mg/kg) | SMS 359 | 1.04 | 3.96 | 79.4 | 127 | 162 |
| Chlorine (mg/kg) | UK 3366 | 0.1 | 0.8 | 0.5 | 0.7 | 0.2 |
| Acidity (mgKOH/g) | ASTM D1613-2 | 0.1189 | 0.0724 | <0.001 | <0.001 | 0.01 |
| Metals | TMS 573/06 | No metals present at levels above detection limits | | | | |

TABLE 3

Gasoline base fuels.

| Parameter | Base 1 | Base 2 |
|---|---|---|
| RON (ASTM D2699) | 96.1 | 97.3 |
| MON (ASTM D2700) | 85.2 | 86.0 |
| Density at 15° C. (IP365) (kg/m$^3$) | 746.4 | 746.5 |
| IBP (IP123) (° C.) | 30.6 | 31.8 |
| 10% rec. (IP123) (° C.) | 51.8 | 52.9 |
| 20% rec. (IP123) (° C.) | 63.4 | 63.5 |
| 30% rec. (IP123) (° C.) | 75.4 | 74.9 |
| 40% rec. (IP123) (° C.) | 87.4 | 88.0 |
| 50% rec. (IP123) (° C.) | 98.5 | 101.3 |
| 60% rec. (IP123) (° C.) | 108.7 | 112.7 |
| 70% rec. (IP123) (° C.) | 119.1 | 123.8 |
| 80% rec. (IP123) (° C.) | 134.0 | 138.0 |
| 90% rec. (IP123) (° C.) | 153.5 | 155.0 |
| 95% rec. (IP123) (° C.) | 168.6 | 167.9 |
| FBP (IP123) (° C.) | 196.0 | 195.2 |
| RVP * (IP394) (kPa) | 60.2 | 67.9 |
| Olefins (inc. dienes) (% vol.) | 13.1 | 14.8 |
| Aromatics (% vol.) | 31.8 | 36.5 |

Metal Pick-Up

To assess the impact of the pinene samples on the propensity of gasoline to pick up metals (zinc, lead and copper) the following test procedure was performed. 250 ml of the gasoline composition to be tested was placed in HDPE bottles with screw top lids, to prevent evaporation of the liquid. A 20 ml sample of the gasoline composition was collected immediately before the immersion of the metal coupons and analysed. Freshly polished/cleaned metal coupons are placed in the beakers, such that the coupons remain immersed at all times during the tests but do not lie flat on the bottom of the beaker, and the samples left undisturbed. Further 20 ml samples of fuel or blend are collected from each beaker at pre-selected time intervals during the test and analysed, with the contents of the beaker being stirred prior to sampling.

The metal test coupons used in the test were 7 cm×2.5 cm coupons of brass, galvanized steel, and terne plate.

The tested gasoline samples were analysed using ICP-AES for lead, zinc, and copper.

For the performance of the metal pick-up test, gasoline samples were prepared using base gasolines "Base 1" and "E10" and pinene compositions P1 to P5. The concentration of the pinene compositions, when included in the gasoline composition, was 5% v/v. All of the gasoline compositions used in the metal pick-up tests additionally contained a proprietary gasoline performance additive package at a concentration of 1780 mg/kg. The results of the metal pick-up tests are provided in Tables 5 to 10 below.

TABLE 5

Zinc pick-up for non-ethanol containing gasoline compositions.

| Example | Gasoline | Metal pick-up (ppbw) After 0 days | Metal pick-up (ppbw) After 7 days |
|---|---|---|---|
| A* | Base 1 | 10 | 79 |
| B* | Base 1 + P1 | 0 | 520 |
| C* | Base 1 + P2 | 0 | 260 |
| 2 | Base 1 + P3 | 0 | 120 |
| 3 | Base 1 + P4 | 0 | 180 |
| 4 | Base 1 + P5 | 0 | 160 |

*Comparative Example

TABLE 6

Copper pick-up for non-ethanol containing gasoline compositions.

| Example | Gasoline | Metal pick-up (ppbw) After 0 days | Metal pick-up (ppbw) After 7 days |
|---|---|---|---|
| D* | Base 1 | 15 | 760 |
| E* | Base 1 + P1 | 0 | 1500 |
| F* | Base 1 + P2 | 0 | 1400 |
| 5 | Base 1 + P3 | 0 | 600 |
| 6 | Base 1 + P4 | 0 | 1100 |
| 7 | Base 1 + P5 | 0 | 1200 |

*Comparative Example

TABLE 7

Lead pick-up for non-ethanol containing gasoline compositions.

| Example | Gasoline | Metal pick-up (ppbw) After 0 days | Metal pick-up (ppbw) After 7 days |
|---|---|---|---|
| G* | Base 1 | 10 | 3500 |
| H* | Base 1 + P1 | 0 | 2000 |

TABLE 7-continued

Lead pick-up for non-ethanol containing gasoline compositions.

| Example | Gasoline | Metal pick-up (ppbw) After 0 days | After 7 days |
|---|---|---|---|
| I* | Base 1 + P2 | 0 | 2800 |
| 8 | Base 1 + P3 | 600 | 1400 |
| 9 | Base 1 + P4 | 800 | 800 |
| 10 | Base 1 + P5 | 0 | 800 |

*Comparative Example

TABLE 8

Zinc pick-up for E10 gasoline compositions.

| Example | Gasoline | Metal pick-up (ppbw) After 0 days | After 7 days | After 28 days |
|---|---|---|---|---|
| J* | E10 | 11 | 33.5 | 68.5 |
| K* | E10 + P1 | 0 | 180 | 220 |
| L* | E10 + P2 | 0 | 200 | 260 |
| 11 | E10 + P3 | 0 | 160 | 200 |
| 12 | E10 + P4 | 0 | 80 | 100 |
| 13 | E10 + P5 | 0 | 160 | 190 |

*Comparative Example

TABLE 9

Copper pick-up for E10 gasoline compositions.

| Example | Gasoline | Metal pick-up (ppbw) After 0 days | After 7 days | After 28 days |
|---|---|---|---|---|
| M* | E10 | 10 | 2460 | 2195 |
| N* | E10 + P1 | 0 | 1700 | 6400 |
| O* | E10 + P2 | 0 | 1300 | 4600 |
| 14 | E10 + P3 | 0 | 1600 | 3400 |
| 15 | E10 + P4 | 0 | 1100 | 1500 |
| 16 | E10 + P5 | 0 | 2000 | 2900 |

*Comparative Example

TABLE 10

Lead pick-up for E10 gasoline compositions.

| Example | Gasoline | Metal pick-up (ppbw) After 0 days | After 7 days | After 28 days |
|---|---|---|---|---|
| P* | E10 | 10 | 2320 | 9500 |
| Q* | E10 + P1 | 1200 | 10000 | 16200 |
| R* | E10 + P2 | 1000 | 5200 | 8800 |
| 17 | E10 + P3 | 1000 | 1600 | 2000 |
| 18 | E10 + P4 | 1000 | 1800 | 4400 |
| 19 | E10 + P5 | 0 | 2600 | 13000 |

*Comparative Example

As can clearly be seen from the results above, the overall propensity of the gasoline compositions to pick-up metals can be significantly lower for gasoline compositions containing a low acidity terpene composition (Examples 2 to 19) compared to gasoline compositions containing a higher acidity terpene composition (comparative Examples A to R), i.e. the propensity for the gasoline to pick up at least one of the three metals measured is reduced for the gasoline compositions of the present invention by comparison to the gasoline compositions containing a higher acidity terpene composition.

Steel Corrosion

The impact of 5% by volume of each of the different pinene samples on the inherent tendency for base gasoline to cause steel corrosion is summarised in Table 11 below. The tendency for the gasoline composition to cause steel corrosion was measured according to a modified version of the ASTM D665 test, wherein 300 ml of the gasoline composition to be tested was stirred with 30 ml of distilled water at ambient temperature, with a steel test rod completely immersed therein. The steel test rod was a round steel test rod fitted to a plastic holder, said rod being 12.7 mm in diameter and approximately 68 mm in length exclusive of the threaded portion which screws into the plastic holder and tapered at one end and made of steel conforming to Grade 10180 of Specification A 108 or to BS 970 Part I: 1983-070M20. The test duration was 5 hours. The test rod is then observed for signs of rusting and degree of rusting. A rating of 0 denotes no rust formation, whilst 1 denotes 6 spots of rust or less, a rating of 2 denotes more than 6 spots of rust but total coverage is less than 5% of the test specimen and a rating of 3 is for rusting in excess of 5%.

For the performance of the steel corrosion test, gasoline samples were prepared using base gasoline "Base 2" and pinene compositions P1 to P5. The concentration of the pinene compositions, when included in the gasoline composition, was 5% v/v.

TABLE 11

Steel Corrosion.

| Example | Gasoline | Steel Corrosion Rating |
|---|---|---|
| S* | Base 2 | 3 |
| T* | Base 2 + P1 | 3 (lacquer) |
| U* | Base 2 + P2 | 3 (lacquer) |
| 20 | Base 2 + P3 | 0 |
| 21 | Base 2 + P4 | 0 |
| 22 | Base 2 + P5 | 1 |

*Comparative Example

As can be seen from the results in Table 11 above, the gasoline compositions according to the present invention exhibit lower levels of steel corrosion compared to the base gasoline composition and the gasoline compositions containing higher acidity terpene compositions.

What is claimed is:

1. A gasoline composition comprising:

(a) a gasoline base fuel; and (b) a terpene composition in an amount in the range of from 0.1 to 40% vol. based on total gasoline composition, said terpene composition comprising at least 60% wt. pinenes and having an acidity of at most 0.05 mgKOH/g.

2. The gasoline composition of claim 1 wherein the amount of terpene composition in the overall gasoline composition is in the range of from 0.5 to 30% vol.

3. The gasoline composition of claim 2 wherein the amount of terpene composition is in the range of from 2 to 10% vol.

4. The gasoline composition of claim 1 wherein the terpene composition comprises at least 70% wt. pinenes.

5. The gasoline composition of claim 4 wherein the terpene composition comprises at least 75% wt. pinenes.

6. The gasoline composition of claim 5 wherein the terpene composition comprises at least 80% wt. pinenes.

7. The gasoline composition of claim 2 wherein the terpene composition comprises at least 70% wt. pinenes.

8. The gasoline composition of claim 3 wherein the terpene composition comprises at least 70% wt. pinenes.

9. The gasoline composition of claim 7 wherein the terpene composition comprises at least 75% wt. pinenes.

10. The gasoline composition of claim 8 wherein the terpene composition comprises at least 75% wt. pinenes.

11. The gasoline composition of claim 1 wherein the terpene composition comprises at least 60% wt. alpha-pinene.

12. The gasoline composition of claim 11 wherein the terpene composition comprises at least 70% wt. alpha-pinene.

13. The gasoline composition of claim 12, wherein the terpene composition comprises at least 75% wt. alpha-pinene.

14. The gasoline composition of claim 13 wherein the terpene composition comprises at least 80% wt. alpha-pinene.

15. The gasoline composition of claim 14 wherein the amount of terpene composition is in the range of from 2 to 10% vol.

16. The gasoline composition of claim 1 wherein the acidity of the terpene composition is at most 0.025 mgKOH/g.

17. The gasoline composition of claim 16 wherein the acidity of the terpene composition is at most 0.02 mgKOH/g.

18. The gasoline composition of claim 15 wherein the acidity of the terpene composition is at most 0.02 mgKOH/g.

19. A process for preparing a gasoline composition, which comprises admixing with a gasoline base fuel, a terpene composition comprising at least 60% wt. pinenes and having an acidity of at most 0.05 mgKOH/g, in an amount in the range of from 0.1 to 40% vol. based on total gasoline composition.

20. The process of claim 19 wherein the amount of terpene composition is in an amount in the range of from 2 to 10% vol. based on total gasoline composition, said terpene composition comprises at least 75% wt. alpha-pinene and the acidity is at most 0.02 mgKOH/g.

21. A method for reducing the metal pick-up propensity of terpene containing gasoline composition, said method comprising blending in a gasoline base fuel a terpene composition which comprises at least 60% wt. pinenes and has an acidity of at most 0.05 mgKOH/g as the terpene component of the gasoline composition, in an amount in the range of from 0.1 to 40% vol.

22. The method of claim 21 wherein the amount of terpene composition is in an amount in the range of from 2 to 10% vol. based on total gasoline composition, said terpene composition comprises at least 75% wt. alpha-pinene and the acidity is at most 0.02 mgKOH/g.

* * * * *